United States Patent [19]

Austin

[11] 4,222,329

[45] Sep. 16, 1980

[54] UNDERWATER CUTTING DEVICE

[75] Inventor: Carl F. Austin, Inyokern, Calif.

[73] Assignee: The United States of America as represented by the Secretary of the Navy, Washington, D.C.

[21] Appl. No.: 380,639

[22] Filed: Jul. 16, 1973

Related U.S. Application Data

[63] Continuation-in-part of Ser. No. 184,967, Sep. 24, 1971, abandoned.

[51] Int. Cl.[3] ..... F42B 1/02

[52] U.S. Cl. ..... 102/24 HC; 102/56 SC

[58] Field of Search ..... 102/24, 24 HC, 56, 56 SC

[56] References Cited

U.S. PATENT DOCUMENTS 2,513,233 6/1950 Byers ..... 102/24 HC

FOREIGN PATENT DOCUMENTS 1231003 4/1960 France ..... 102/24 HC 1400814 4/1965 France ..... 102/24 HC

*Primary Examiner*—Peter A. Nelson

*Attorney, Agent, or Firm*—R. S. Sciascia; W. Thom Skeer; L. E. K. Pohl

[57] ABSTRACT

An underwater cutting device which utilizes a W shaped liner to separate a linear explosive charge from a watertight standoff volume. The liner is fabricated by bending a single metal plate. A V shaped hood is affixed to the outer edges of the W shaped liner and the charge is contained between the hood and the liner. A metal box having the shape of a flat bottomed U is welded to the points of the depression in the W and in cooperation with end pieces, provides the watertight standoff volume.

1 Claim, 2 Drawing Figures

UNDERWATER CUTTING DEVICE

CROSS-REFERENCE TO RELATED APPLICATION

This is a continuation-in-part of application Ser. No. 184,967 filed Sept. 24, 1971, and now abandoned.

BACKGROUND OF THE INVENTION

1. Field of the Invention

This invention relates to underwater cutting devices. More particularly, this invention relates to devices for cutting holes in the armor of ships and the like which utilize shaped linear explosive charges.

2. Description of the Prior Art

Cutting devices comprising a housing divided by a liner into an explosive charge containing compartment and a watertight standoff volume are well known. In the prior art, such devices have typically utilized liners having shapes ranging from that of a half circle to that of an inverted V. Liners having such shapes have done their jobs adequately. Therefore, improvements in cutting devices have, over the years, generally been concerned with parts other than liners and the shape of the liners has remained fairly constant.

SUMMARY OF THE INVENTION

It has now been found, as the result of research, that an underwater cutting device which utilizes a W shaped liner to contain the linear shaped explosive charge is superior to one which utilizes a V shaped liner to contain a like amount of explosive. An underwater cutting device according to this invention comprises a W shaped metallic liner, a V shaped metallic hood affixed to the upper edges of the W, an explosive charge filling the space between the liner and the hood, means for detonating the charge, and a metallic box in the shape of a flat bottomed U affixed to the points of the depressions of the W to provide a watertight standoff volume. Steel is a suitable material from which to fabricate the metallic parts.

DESCRIPTION OF THE PREFERRED EMBODIMENT

Figure 1:
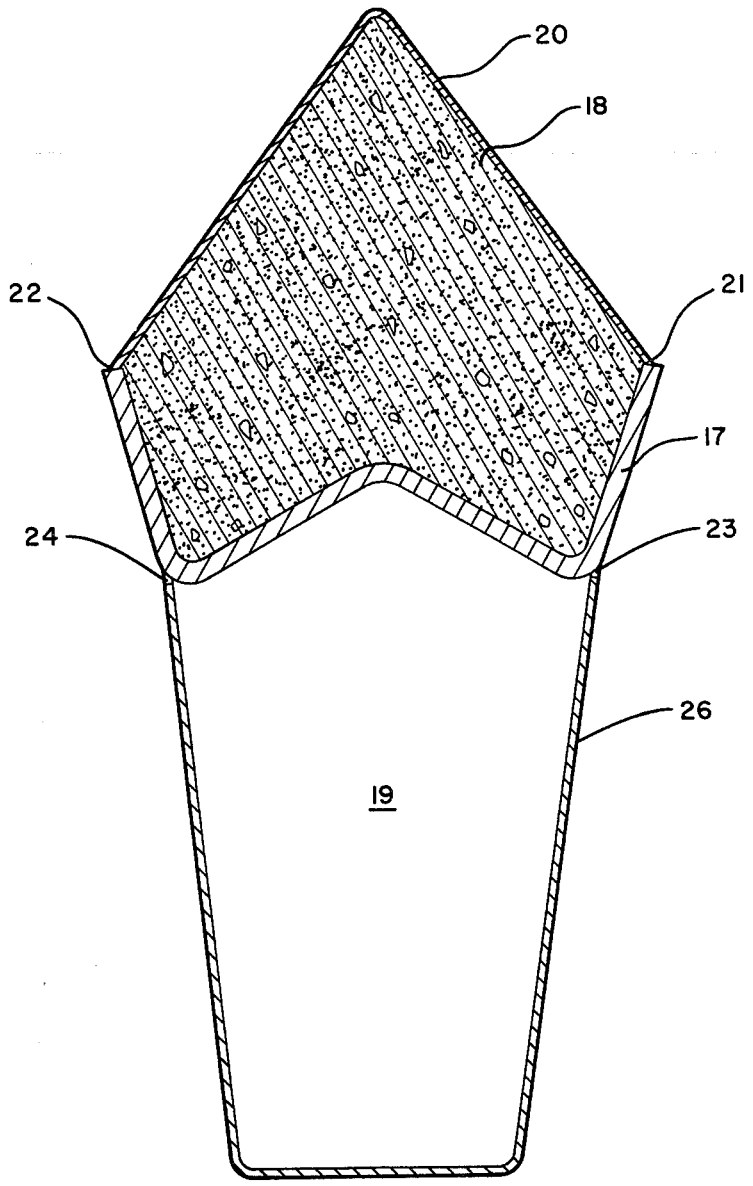
FIG. 1 is a cross sectional view of an underwater cutting device according to the present invention.
Figure 2:
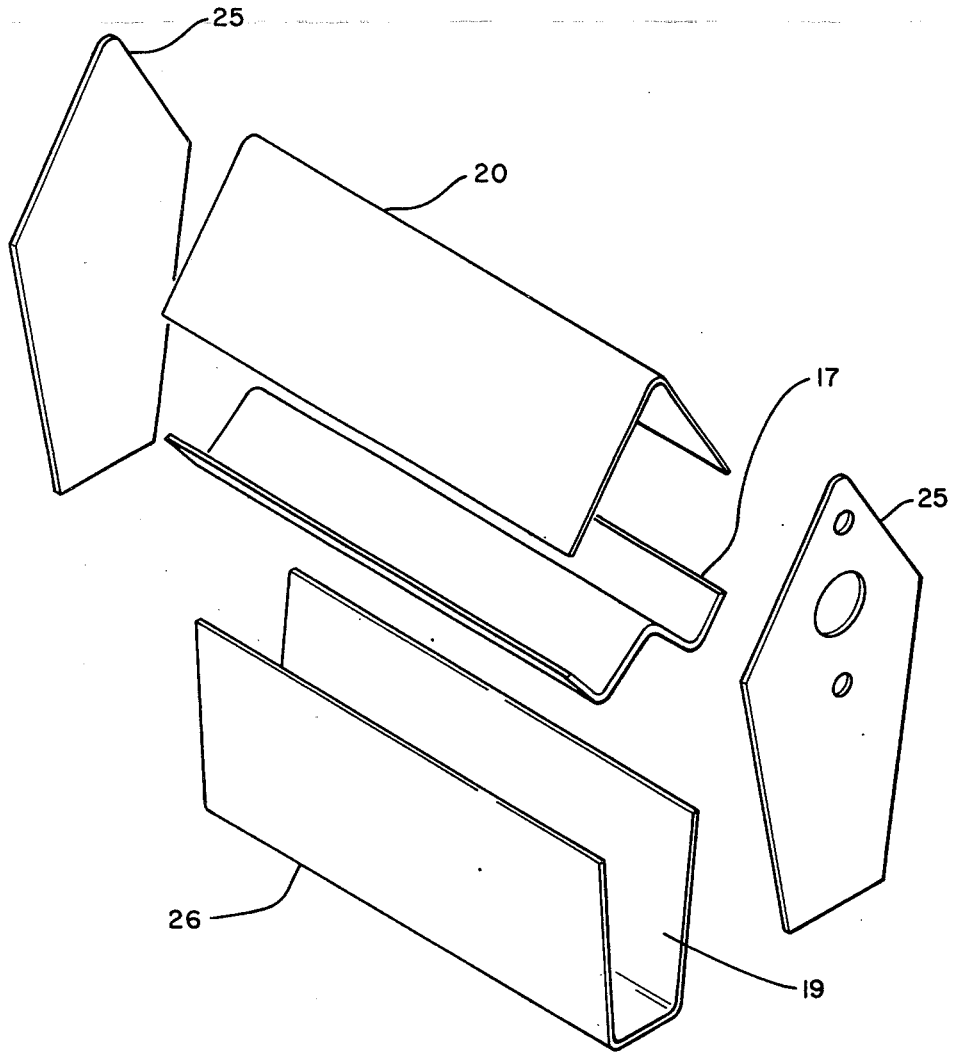
FIG. 2 is an exploded view of the device of FIG. 1.

FIG. 1 of the drawing shows a cross sectional view of a linear shaped charge underwater cutting device according to the present invention. Rather than utilizing a V shaped liner, the device shown utilizes a W shaped liner 17 to separate the explosive charge 18 from a standoff volume 19. The standoff volume is defined by a box 26 and end plates 25 (FIG. 2). The liner may be fabricated by bending a single rectangular sheet of mild steel or other suitable metal into a W shape with the depressions of the W running the longest length of the rectangle. The explosive charge is covered by a hood 20 which is affixed by welding or other suitable means to the W shaped liner at its upper edges 21 and 22 and the box 26 in the shape of a flat bottomed U, which partially defines standoff volume 19, is affixed by welding or other suitable means to points 23, 24 of the depressions of the W shaped liner and defines a standoff volume.

Like the liner, the hood and the box may be fabricated from mild steel or some other suitable metal.

FIG. 2 shows an exploded view of the device of FIG. 1. In addition to liner 17, standoff volume 19 and hood 20, FIG. 2 shows two end pieces 25 (mentioned above but not shown in FIG. 1) which close the ends of the device and render it watertight. The three holes (not numbered) shown in the one end piece are provided for the insertion of a detonating device or devices (not shown) and for the purpose of loading the device with explosive. The three holes are naturally either plugged with detonating devices or, in the case of the loading hole, provided with a plug to insure watertightness during operation. It is obvious than many types of detonating devices could be used and, depending upon the device, the number of holes would be varied. Also, it is obvious that, as in the cases where other parts are affixed to each other, welding or any other suitable means may be utilized to attach the end pieces to the device. The end pieces, like the other metallic parts, may be fabricated from mild steel or some other suitable metal.

At first glance, a prior art device utilizing a V shaped liner and the device according to the present invention as depicted in the drawing would appear to be similar to each other. However, tests comparing the two types of devices have revealed that devices which utilize W shaped liners are greatly superior to those which utilize V shaped liners.

One series of tests pitted devices utilizing $\frac{3}{8}$ inch thick V shaped liners and an 11 inch standoff against devices utilizing $\frac{3}{8}$ inch thick W shaped liners and an 11 inch standoff. The two types of devices were loaded with like amounts of the same explosive and fired against stacks of twelve 1 inch thick steel plates in air. Devices fired in air and utilizing V shaped liners consistently cut through and destroyed the first 6 plates but only dented the 7th plate whereas devices utilizing W shaped liners under the same conditions consistently demonstrated a depth of cut equal to 133% of that obtained with the simple V type liner.

Underwater tests against a 2 inch steel target showed that the W shaped liner and standoff volume performed well together, yielding a cut in the sea floor several feet below the target plate position. The W charge was found to cut 6 inch steel targets (backed by air) to yield a very smooth clean cut.

What is claimed is:

1. A linear underwater cutting device having a uniform cross section at right angles to its linear axis comprising:

(a) a metallic liner which is W shaped in cross section having outer upper edges and depressions;

(b) a hood member having a shape approximating that of an inverted V in cross section and having outer edges joined to the outer upper edges of said W shaped liner;

(c) a box having a shape approximating that of a flat bottomed U in cross section and having upper outer edges joined to the points of the depressions of said W shaped liner;

(d) a linear shaped explosive charge confined in and substantially filling the space between said W shaped linear and said hood member; and (e) means for attaching a detonating device to said underwater cutting device.

* * * * *